US006216584B1

(12) United States Patent
Terauchi

(10) Patent No.: US 6,216,584 B1
(45) Date of Patent: Apr. 17, 2001

(54) PISTON HAVING AN IMPROVED BARREL PORTION, AND A COMPRESSOR USING THE SAME

(75) Inventor: Kiyoshi Terauchi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/275,794

(22) Filed: Mar. 25, 1999

(51) Int. Cl.[7] ..... F01B 31/10
(52) U.S. Cl. ..... 92/160; 92/186; 92/237
(58) Field of Search ..... 92/172, 71, 12.2, 92/160, 186, 237; 417/269

(56) References Cited

U.S. PATENT DOCUMENTS

| | | | | |
|---|---|---|---|---|
| 4,132,510 | | 1/1979 | Takahashi | 417/534 |
| 4,373,876 | | 2/1983 | Nemoto | 417/534 |
| 4,638,725 | * | 1/1987 | Ripberger et al. | 92/237 |
| 4,697,992 | * | 10/1987 | Hatakeyama et al. | 417/269 |
| 5,630,353 | | 5/1997 | Mittlefehldt et al. | 92/71 |
| 5,765,464 | | 6/1998 | Morita | 92/71 |
| 5,899,135 | | 5/1999 | Kanou et al. | 92/71 |

FOREIGN PATENT DOCUMENTS

| | | |
|---|---|---|
| 0780572 | 6/1997 | (EP) . |
| 9105380 | 4/1997 | (JP) . |

* cited by examiner

*Primary Examiner*—Edward K. Look
*Assistant Examiner*—Thomas E. Lazo
(74) *Attorney, Agent, or Firm*—Baker Botts L.L.P.

(57) ABSTRACT

For being slidably inserted into a cylinder bore defined by a cylindrical surface extending in a predetermined direction, a piston (8) has a head portion (81) extending perpendicular to the predetermined direction and a barrel portion (82) connected to the head portion. The head portion has an outer circumferential portion which is close to the cylindrical surface when the piston is inserted in the cylinder bore. The barrel portion has at least three wall portions (82*a*, 82*b*, 82*c*) which are extended from the outer circumferential portion in the predetermined direction. The wall portions are arranged in a circumferential direction to form a substantially cylindrical shape in cooperation with one another.

10 Claims, 3 Drawing Sheets

EARLIER TECHNOLOGY

PISTON HAVING AN IMPROVED BARREL PORTION, AND A COMPRESSOR USING THE SAME

BACKGROUND OF THE INVENTION

The present invention relates in general to a piston and more particularly to a piston suitable for a compressor such as a swash plate type compressor.

A piston of the type is disclosed in Japanese Patent Unexamined Publication No. 9-105380/1997, which will be shown in FIG. 3 of the attached drawing. The piston is indicated by reference numeral 8 in FIG. 3 and has a head portion 81 of a hollow structure and a shoe receiver 84.

The piston shown in FIG. 3 has a hollow head portion 81 and, therefore, has an advantage that it is light weighed. However, in an integral formation of the piston by casting, it is almost impossible to form the head portion in a hollow structure. Thus, the piston is formed by a casting method by dividing the entire structure into two parts and then the two parts should be coupled together by welding. This results in a substantial increase in production cost.

Another piston of the type is disclosed in Japanese Patent Application No. 9-126899 earlier filed by the present applicant (assignee), which is shown in FIG. 4 of the drawing. The piston 8 of FIG. 4 has a head portion 81, a shell or barrel portion 82 connected with the head portion 81, and a shoe receiving portion 84. The barrel portion 82 has a U-shaped sectional shape at a surface intersecting at right angles to a reciprocal moving direction of the piston 8.

The piston of FIG. 4, on the other hand, has solved the problem of the piston of FIG. 3. Since the head portion 81 of FIG. 4 is of a solid structure, the barrel portion 82 having a U-shaped sectional shape, it can be produced integrally or entirely by casting. Accordingly, the production cost can be reduced relative to the piston of FIG. 3. However, in the piston of FIG. 4, when the piston 8 is slidably inserted into a cylinder bore (not shown), a deviation or offset of the piston 8 in the direction intersecting at right angles to a center of the cylinder bore can not be restricted by the barrel portion 82 and, therefore, it is likely that an opening side of the barrel is abnormally worn out, resulting in considerable reduction of durability.

SUMMARY OF THE INVENTION

It is therefore an object of the present invention to provide a new and improved piston which permits reduction of cost and weight and has a considerable durability.

It is another object of the present invention to provide a compressor using the piston.

Other objects of the present invention will become clear as the description proceeds.

According to an aspect of the present invention, there is provided a piston for being slidably inserted into a cylinder bore defined by a cylindrical surface extending in a predetermined direction. The piston comprises a head portion extending perpendicular to the predetermined direction and having an outer circumferential portion which is close to the cylindrical surface when the piston is inserted in the cylinder bore, and a barrel portion connected to the head portion. In the piston, the barrel portion comprises at least three wall portions which are extended from the outer circumferential portion in the predetermined direction and arranged in a circumferential direction to form a substantially cylindrical shape in cooperation with one another.

According to another aspect of the present invention, there is provided a piston slidably inserted into a cylinder bore in a cylinder block. The piston comprises a head portion having an outer circumferential surface entirely slidably contacted with an inner circumferential surface of the cylinder bore, and a barrel portion connected with, and extending from, the head portion, and having an outer circumferential surface consisted with at least three circumferential wall portions extending along the slidable movement direction of the piston. In the piston, the at least three circumferential wall portions are located at a position where the barrel portion is unable to move in a direction perpendicular to the center of the cylinder bore.

According to still another aspect of the present invention, there is provided a compressor which comprises a cylinder block having a cylinder bore extending in a predetermined direction, a piston mentioned above and slidably inserted in the cylinder bore, and means coupled to the piston for making the piston be reciprocally moved along the cylinder bore in the predetermined direction.

DESCRIPTION OF THE PREFERRED EMBODIMENT

Figure 2:
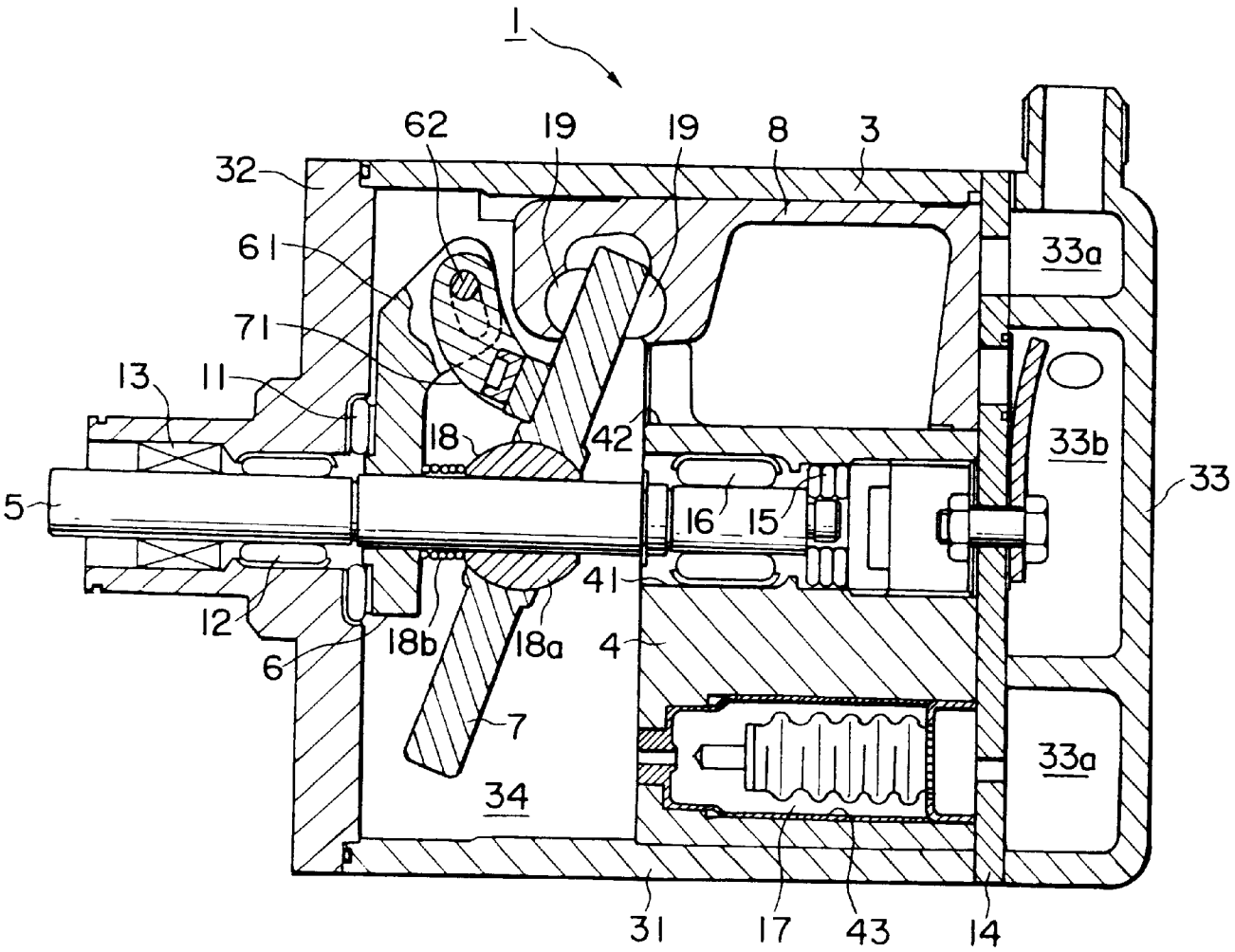
FIG. 2 is a vertical sectional view of a swash plate type compressor using the piston shown in FIG. 1A.
Figure 3:
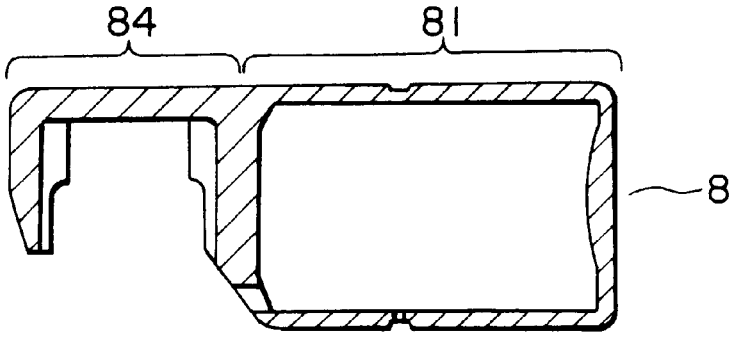
FIG. 3 PRIOR ART
FIG. 3 is a sectional view of a conventional piston.
Figure 4:
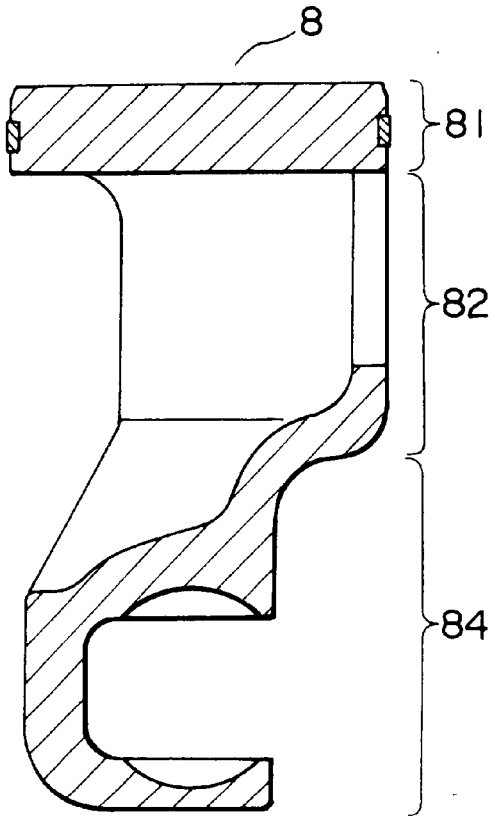
FIG. 4 is a sectional view of a piston in an earlier technology.

Referring first to FIG. 2, description will be made as regards a swash plate type compressor 1 comprising a piston according to an embodiment of the present invention. The compressor is designated by a reference numeral 1 and has a displacement volume variable in the manner known in the art. The compressor 1 comprises, in addition to the piston 8, a housing 3, a cylinder block 4, a driving shaft 5, and a swash plate 7.

The housing 3 has a housing body 31, a front end plate 32 and a cylinder head 33. The housing body 31 is substantially cylindrical as illustrated. The front end plate 32 is fitted to an opening end of he housing body 31 to close the opening. The front end plate 32 has, at its central portion, a thrust needle bearing 11, radial needle bearing 12 and an axial sealing member 13. The cylinder head 33 has a suction chamber 33*a* and a discharge (exhaust) chamber 33*b*, and a valve plate 14 is fixedly provided to the cylinder block 4.

The cylinder block 4 is disposed at the other end portion of the housing body 31, and a crank chamber 34 is formed between the cylinder block 4 and the front end plate 32. The cylinder block 4 has a central hole 41, a plurality of cylinder bores 42, and a valve chamber 43. The central hole 41 is formed at a central portion of the cylinder block 4 and extends in a predetermined direction. The central hole 41 includes therein a thrust needle bearing 15 and a radial needle bearing 16. The cylinder bores 42 are provided, around the central hole 41, at a constant interval on the outer portion of the cylinder block 4. Each of the cylinder bores 42 is defined by a cylindrical surface extending in the predetermined direction. The piston 8 is slidably inserted into each of the cylinder bores 42.

The valve chamber 43 is formed between adjacent cylinder bores 42. A control valve device 17 is provided in the valve chamber 43. The control valve device 17 has a structure that it permits the gas in the crank chamber 34 to escape into the suction chamber 33*a* when an inner pressure of the crank chamber 34 exceeds a predetermined value. By this mechanism, the pressure in the crank chamber 34 is maintained constant as desired.

The driving shaft 5 is extended, at its one end, outside the housing 3 through the front end plate 32 and the one end portion of the driving shaft 5 is rotatably supported by the front end plate 32 through radial needle bearing 12. The other end portion of the driving shaft 5 is rotatably supported by the cylinder block 4 through the radial needle bearing 16. A slide member 18 is fitted to the driving shaft 5. The slide member 18 is slidable in an axial direction of the driving shaft 5 and has a spherical portion 18*a* and a cylindrical portion 18*b*.

The rotor 6 has an arm 61 which has at its end a pin 62. The rotor 6 is fixed to the driving shaft 5 in the crank chamber 34 and has a surface which is contacted against the thrust needle bearing 11.

The swash plate 7 is substantially disc shaped and fitted rotatably to the spherical portion 18*a* of the slide member 18. The swash plate 7 has an arm 71 which is rotatably connected with the arm 61 of the rotor 6 by means of the pin 62 so that the swash plate 7 is rotated along with the driving shaft 5 and permits a change of the inclination angle of the swash plate 7 relative to the axial direction of the driving shaft 5. The displacement volume of the compressor 1 varies in accordance with the change of the inclination angle in the manner known in the art.

Figure 1A:
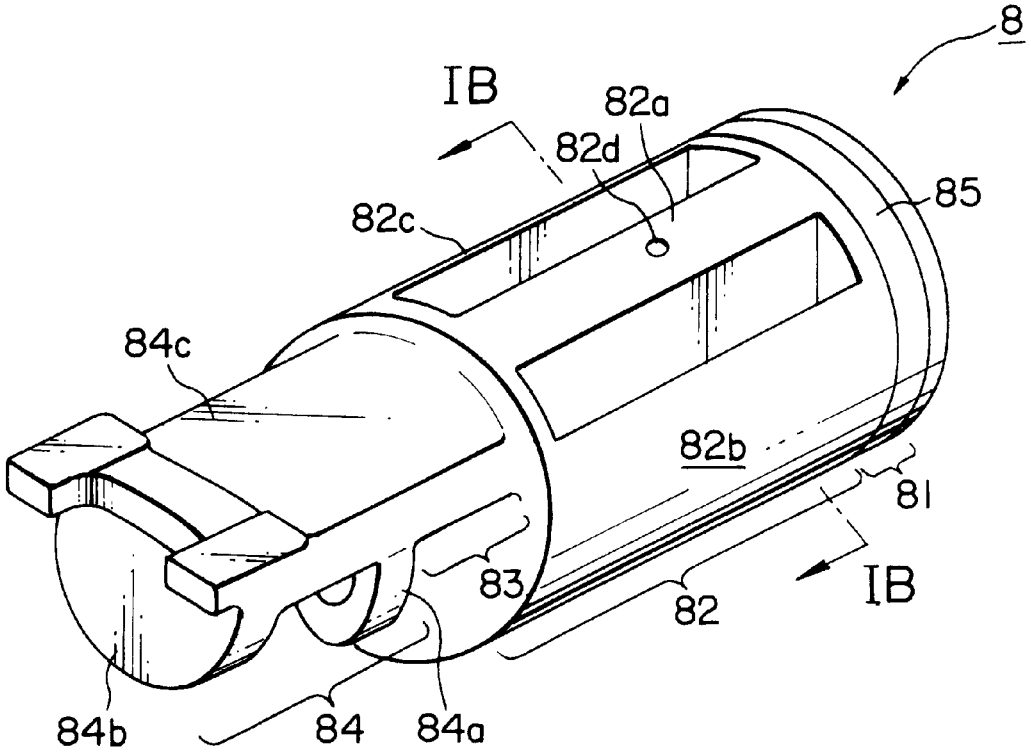
FIG. 1A is a perspective view of a piston according to an embodiment of the present invention.
Figure 1B:
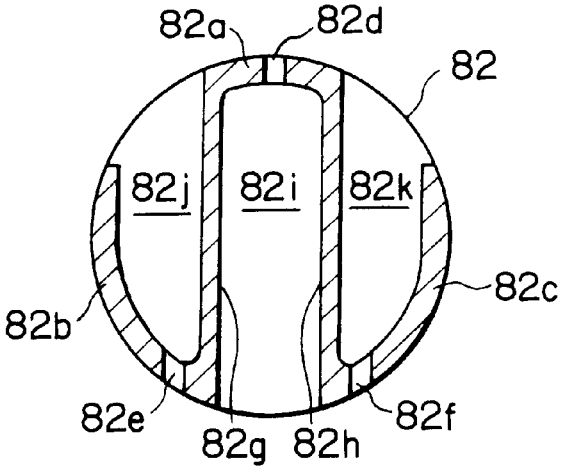
FIG. 1B is a sectional view of the piston, taken along IB—IB in FIG. 1A.

Referring to FIGS. 1A and 1B together with FIG. 2, the description will be made as regards the piston 8. In the manner which will presently be described, the piston 8 has a head portion 81, a barrel portion 82, a connector portion 83 and a shoe receiver portion 84, all of which are formed unitarily by casting.

The head portion 81 is of a disc shape extending perpendicular to the predetermined direction and has a solid structure. The head portion 81 is for serving to compress the gas in the cylinder bore 42. For this purpose, the head portion 81 has an outer circumferential portion which is closed to the cylindrical surface when the piston 8 is inserted in each cylinder bore 42. Further, the head portion 81 is provided with a piston ring 85 as shown. The head portion 81 may be formed to be in slidable contact with the cylindrical surface of each cylinder bore 42.

The barrel portion 82 comprises first, second, and third partial circumferential wall portions 82*a*, 82*b*, and 82*c* which are extended along the cylinder bore 42 or the cylindrical surface in the predetermined direction. The wall portions 82*a* to 82*c* are extended from the outer circumferential portion of the head portion 81 in the predetermined direction. The wall portions 82*a* to 82*c* are arranged to separate and disperse in a circumferential direction. Thus, the wall portions 82*a* to 82*c* form a substantially cylindrical shape in cooperation with one another.

The wall portions 82*a* to 82*c* are disposed in the cylinder bore 42 such that the barrel portion 82 is unable to move in the direction perpendicular to a central line of the cylinder bore 42. For this purpose, it is preferably designed that the central line of the cylinder bore 42 is located within a polygonal shape (that is, a triangular shape in this embodiment) which is formed by connecting points which are located at a center of the substantially cylindrical shape formed by the wall portions 82*a* to 82*c*. Each of the wall portions 82*a* to 82*c* has an outer surface of an arc-like sectional shape. The wall portions 82*a* to 82*c* have through holes 82*d*, 82*e*, and 82*f*, respectively, penetrating therethrough for escaping a lubricant oil from first, second, and third grooves 82*i*, 82*j*, and 82*k* which will later become clear.

Further, the first and the second partial circumferential wall portions 82*a* and 82*b* are connected with each other by a first partition wall 82*g* extending inside the barrel portion 82. Similarly, the first and the third partial circumferential wall portions 82*a* and 82*c* are connected with each other by the second partition wall 82*h* extending inside the barrel portion 82. The interior of the barrel portion 82 is divided by the partition walls 82*g* and 82*h* to form the first, the second, and the third grooves 82*i*, 82*j*, and 82*k* in the barrel portion 82. The first and second partition walls 82*g* and 82*h* are integrally or unitarily formed with the first to third partial circumferential wall portions 82*a* to 82*c*. It is to be noted that each of the grooves 82*i* to 82*k* has an opening between adjacent ones of the wall portions 82*a* to 82*c*.

The connector portion 83 is of plate-like structure and connected with a lower end of the barrel portion 82. The shoe receiver portion 84 is coupled with the barrel portion 82 by the connector portion 83 and has a pair of shoe receiver tubs 84*a* and 84*b* and a connecting tub 84*c*. The shoe receiver tubs 84*a* and 84*b* support the shoe 19 and the connecting tub 84*c* serves to connect the shoe receiver tubs 84*a* and 84*b* together.

The piston 8 is connected to the swash plate 7 with a pair of shoes 19 disposed therebetween, the shoes 19 being slidably held by the shoe receiver portion 84. By this structure, a rotational movement of the swash plate 7 by the driving shaft 5 is converted into a reciprocal linear movement and then transmitted to the piston 8. Consequently, the piston 8 is reciprocally moved in the cylinder bore 42 to thereby provide a suction/exhaust operation of the piston.

In the piston 8, the wall portions 82*a* to 82*c* are coupled together by the partition walls 82*g* and 82*h* and provides a desirable mechanical strength. Since the barrel portion 82 can be formed in a hollow structure, the piston 8 can be more light weighed than the conventional ones. Further, since the piston 8 can be produced by a single production step, it can be obtained with reduced cost of production. In addition to the above, since no shake or rattling of the piston is generated in the cylinder bore, any abnormal frictional wear is not produced in the piston.

While the present invention has thus far been described in connection with a single embodiment thereof, it will readily be possible for those skilled in the art to put this invention into practice in various other manners. For example, although the description has been described with reference to the swash plate type compressor, the present invention is not limited to this type of compressor but can be extensively used for the other types of compressor. Besides, the piston can be used as a piston for a pump. The partition walls can be omitted if desired.

What is claimed is:

1. A piston for being slidably inserted into a cylinder bore defined by a cylindrical surface extending in a predetermined direction, said piston comprising:

a head portion extending perpendicular to said predetermined direction and having an outer circumferential portion which is close to said cylindrical surface when said piston is inserted in cylindrical bore;

a barrel portion connected to said head portion, said barrel portion comprising at least three wall portions which are extended from said outer circumferential portion in said predetermined direction and arranged in a circumferential direction to form a substantially cylindrical shape in cooperation with one another; and a plurality of partition walls which extend inside said barrel portion and are connected to adjacent ones of said wall portions respectively.

2. A piston as claimed in claim 1, wherein said wall portions are separated and dispersed in said circumferential direction.

3. A piston as claimed in claim 1, wherein said partition walls and said wall portions forms a plurality of grooves inside said barrel portion in cooperation with one another.

4. A piston as claimed in claim 3, wherein each of said grooves has an opening between adjacent ones of said wall portions.

5. A piston as claimed in claim 3, wherein each of said wall portions has a through hole penetrating therethrough.

6. A piston slidably inserted into a cylinder bore in a cylinder block, comprising:

a head portion having an outer circumferential surface entirely slidably contacted with an inner circumferential surface of said cylinder bore; and a barrel portion connected with, and extending from, the head portion, and having an outer circumferential surface consisted with at least three circumferential wall portions extending along the slidable movement direction of the piston;

wherein the at least three circumferential wall portions are located at a position where said barrel portion is unable to move in a direction perpendicular to the center of said cylinder bore.

7. A piston as claimed in claim 6, wherein said outer circumferential surface of the barrel portion is comprised with three partial circumferential wall portions.

8. A piston as claimed in claim 7, wherein said circumferential wall portions are coupled together by partition walls, and three grooves are formed by combination of said circumferential wall portions and said partition walls.

9. A compressor comprising:

a cylinder block having a cylinder bore extending in a predetermined direction;

a piston as claimed in any one of claims 1, 2, and 3–8 and slidably inserted in said cylinder bore; and means coupled to said piston for making said piston be reciprocally moved along said cylinder bore in said predetermined direction.

10. A compressor as claimed in claim 6, wherein said circumferential wall portions have outer surfaces, each of which is of an arc-like sectional shape, and said cylinder bore having a central line located within a polygonal shape formed by connecting a center point of each of said outer surfaces to an adjacent center point of each of the other said outer surfaces, respectively.

* * * * *